US006138687A

United States Patent [19]

Sheffler et al.

[11] Patent Number: 6,138,687

[45] Date of Patent: Oct. 31, 2000

[54] COSMETIC JAR AND APPLICATOR

[75] Inventors: Robert J. Sheffler, Morganville, N.J.; Charles Chang, 55 Westview, Wayne, N.J. 07404

[73] Assignee: Charles Chang, Wayne, N.J.

[21] Appl. No.: 09/327,637

[22] Filed: Jun. 8, 1999

[51] Int. Cl.[7] ..... A45D 33/22

[52] U.S. Cl. ..... 132/295; 132/315; 206/581; 220/504

[58] Field of Search ..... 132/294, 295, 132/296, 297, 300; 220/504, DIG. 26; 206/581, 235

[56] References Cited

U.S. PATENT DOCUMENTS

| | | | |
|---|---|---|---|
| 1,425,138 | 8/1922 | Roystone | 132/295 |
| 1,528,465 | 3/1925 | Wilson | 132/295 |
| 1,534,871 | 4/1925 | Roystone | 132/294 |
| 1,688,042 | 10/1928 | Gaess | 132/295 |
| 2,204,784 | 6/1940 | Abrams | 220/504 |
| 2,401,127 | 5/1946 | Younghusband | 220/504 |
| 5,669,400 | 9/1997 | Sheffler et al. | 132/295 |
| 5,709,232 | 1/1998 | Sheffler et al. | 132/295 |
| 5,836,319 | 11/1998 | Lombardi | 132/294 |
| 5,845,658 | 12/1998 | Sussman | 132/294 |

FOREIGN PATENT DOCUMENTS

| | | | |
|---|---|---|---|
| 521104 | 5/1940 | United Kingdom | 132/295 |

*Primary Examiner*—Todd E. Manahan
*Attorney, Agent, or Firm*—Richard A. Joel, Esq.

[57] ABSTRACT

A cosmetic jar and storage device comprises a substantially cylindrical body having a first recess for holding cosmetic and a second recess for holding an applicator. The recesses are separated by a transverse member into individual compartments. A pin-hinged base maintains the applicator in the lower compartment. The base may be swung completely open to facilitate viewing with an internally mounted mirror. The base and in alternate embodiments the cap are hinged on one side of the device while a recessed portion on the other side facilitates opening of the force fit base and cap.

15 Claims, 1 Drawing Sheet

COSMETIC JAR AND APPLICATOR

CROSS-REFERENCE TO RELATED APPLICATIONS

None

STATEMENT REGARDING FEDERALLY SPONSORED RESEARCH OR DEVELOPMENT

Not applicable

BACKGROUND OF THE INVENTION

1. Field of the Invention

This inventions relates to cosmetic dispensers or compacts and particularly to a class of devices known in the trade as cosmetic "pots". These devices comprise storage devices for various products such as rouges, blush powders, balms, eyeliner and eyelid coloring, etc. and often include applicators or dispensers mounted therein.

2. Description of the Related Art Including Information Disclosed under 37 CRF §§1.97–1.98

The closest prior art appears to be U.S. Pat. No. 5,709,232 to SHEFFLER and CHANG which discloses a cosmetic jar and applicator storage device comprising a cap having a screw-tight seal to hold cosmetic within the device and a base flap which pivots outwardly to permit access to an applicator. Another relevant patent to the same inventors is U.S. Pat. No. 5,669,400 on a cosmetic jar and storage device.

The living hinge disclosed in the prior art is limited to polyolefins while the pin-hinge design of the present invention permits a broad range of material selections including polyolefins, polycarbonates, polyesters, SAN, PS, ABS, etc. which provides certain production, functional and esthetics advantages. Prior art U.S. Pat. No. 5,709,233 provides only a partial opening of the lower compartment due to the living hinge. This reduces the size of the mirror which may be mounted on the inside of the bottom surface. It is important to have the entire surface available for the mirror because of the small size of the eye shadow jar (1.5 inches in diameter). On the other hand, U.S. Pat. No. 5,669,400 cannot have a mirror mounted on the inside of the bottom compartment since it is a telescoping construction. The present invention with its complete opening enables a full size mirror to be mounted on the interior of the bottom surface.

The following patents disclose relevant prior art and are discussed at length in the SHEFFLER et al U.S. Pat. Nos. 5,709,232, namely, 2,201,035; 2,375,027; 2,534,100; 3,613,697; 4,777,969; 5,180,084; 5,348,031; and 5,373,940.

The following additional patents are also believed relevant: U.S. Pat. Nos. 5,515,875; 5,431,176; 4,684,017; 3,674,039; 3,256,892; 1,558,407, 1,556,398, 1,534,871; 1,501,525; 1,497,920; 1,425,138; D403,470; D402,412; and, D398,079.

U.S. Pat. Nos. 4,684,017; 1,501,525 and 5,431,176 disclose compact cases with hinged bases while U.S. Pat. Nos. 3,256,892 and 5,515,875 disclose compacts with living hinges.

The particular invention claimed herein in nowhere disclosed or suggested in the prior art. The invention includes a pin hinged bottom cover for complete opening and access of the lower portion.

SUMMARY OF THE INVENTION

This invention relates to cosmetic jars or compacts and particularly to such jars including a separate compartment for an applicator in addition to a cosmetic compartment and wherein the hinged bottom cover permits complete opening and access to compartment.

The cosmetic jar of this invention comprises a substantially cylindrical device having an upper compartment and a lower compartment separated by a transverse member. The upper compartment contains cosmetic such as blush, powders, balms, etc. while the lower compartment contains an applicator. A pivotal cap is hinged at one end to the cylindrical wall or a transverse member with a pin while a pivotal base is pin-hinged to the wall or transverse member to pivot in the opposite direction. The cap and base secure the cosmetic product and applicator respectively within the jar. Both the cap and base are force fit over the respective compartments and include a recessed portion opposite the hinges to facilitate forcing the cap and applicator open.

alternative embodiments which include a screw-on cap or living hinge may also be provided in combination with a pin-hinged cap or base. The pin-hinge is extremely reliable and inexpensive and as described, possesses numerous advantages over the prior art. The pin hinged base opens completely to facilitate mounting of a mirror in the base compartment. The pin hinged base also does not create a loss of lower compartment volume owing to the mechanical construction of the living hinge.

Accordingly, an object of this invention is to provide a new and improved cosmetic jar and applicator.

Another object of this invention is to provide a new and improved cosmetic jar and applicator having pin hinges for the cap and base.

A further object of this invention is to provide a new and improved compact having segregated upper and lower compartments for cosmetic and an applicator with pivotal covers enclosing said compartments wherein the hinged bottom cover permits complete opening and access to the lower compartment.

A more specific object of this invention is to provide a new and improved dual pot cosmetic holder having pin hinged covers at each end to maintain cosmetic and an applicator in separate compartments with covers which are force fit on the cylindrical walls of the holder and wherein the bottom cover completely opens for access to the lower compartment.

BRIEF DESCRIPTION OF THE DRAWINGS

The above and other objects and advantages of this invention may be more clearly seen when viewed in conjunction with the accompanying drawings wherein.

DETAILED DESCRIPTION OF THE INVENTION

Figure 1:
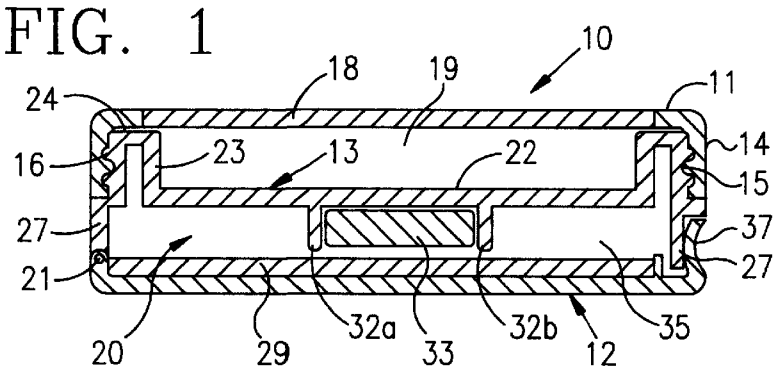
FIG. 1 is a front cross-sectional view of the invention.

Referring now to the drawings, this invention is an improvement over the dual pot cosmetic jars shown in U.S. Pat. Nos. 5,669,400 and 5,709,232. In the former patent namely, U.S. Pat. No. 5,669,400, the bottom base telescopes into an open position while U.S. Pat. No. 5,709,232 discloses a base coupled to the pot with a living hinge. Neither patent discloses the mounting of a full mirror on the interior base surface. Reference may be made to these patents to review the respective constructions.

FIG. 1 discloses a dual pot cosmetic jar 10 having a top cover 11 and a base cover 12 separated by a transverse member 13. The top cover 11 includes downwardly extending peripheral walls 14 having internal threads 15 thereon. The threads 15 engage threads 16 on the solid transverse member 13 thus securing the cover 11 in place. A window 18 may be mounted in the cover 11 sot hat product stored in the upper compartment 19 is visible. The upper compartment 19 is separated from the lower or base compartment 20 by the transverse member 13. The lower compartment 20 is larger than the upper compartment 19.

As shown in FIG. 1, the transverse member 13 comprises a central base portion 22, an upwardly extending portion 23 at the periphery of the base portion 22 extending to a transverse portion 24 which is parallel to the base portion 22 and a downwardly extending wall 27 having an outward protrusion 25 to engage the cover 11. A pin hinge 21 is mounted to the transverse member 13 at the one end and the base cover 12 at the other end. The outer walls of the cover 11, transverse member 13, and the base 12 are flush mounted to provide a smooth exterior surface, which will not snag within a pocketbook.

The base 12 is mounted to the member 27 with a pin hinge 21 at one end to swing completely out of the way. A mirror 29 is mounted along the interior surface 31 to be fully visible when the base is swung openly for view. This operation is best seen in FIG. 2.

The transverse member includes downwardly extending ribs 32*a*, 32*b* which hold a brush or applicator 33 within the lower compartment 20. Alternatively the ribs can be removed to leave open space, see FIG. 3.

Figure 2:
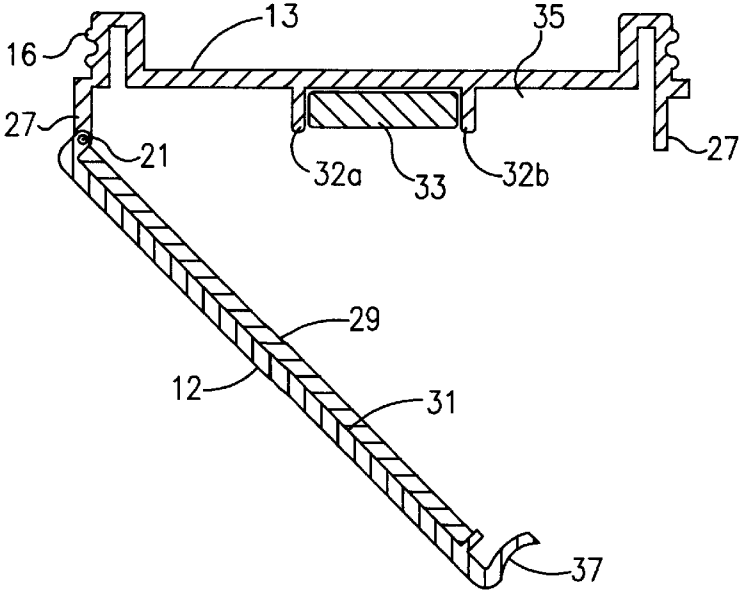
FIG. 2 is a partial cross-sectional view of the invention with the base open.

The bottom or base cover pivots completely as shown in FIG. 2 about pin 21. The mirror 29 is mounted to the base 12 and is readily visible when the base is pivoted into an open position.

Figure 3:
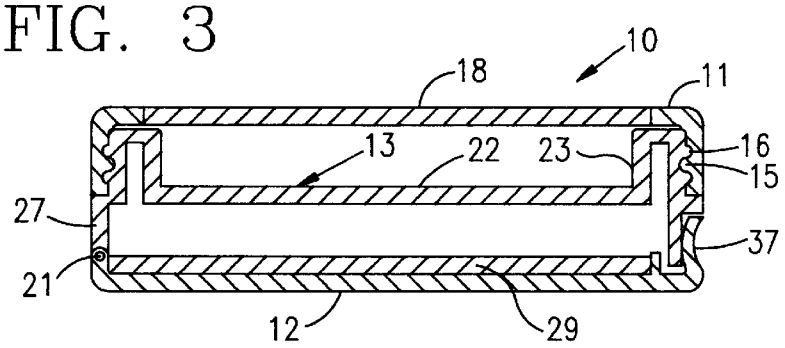
FIG. 3 is a cross-sectional view of an alternate embodiment of the invention without extended ribs to hold a brush/applicator.

FIG. 3 shows an alternate embodiment without the ribs 32*a*, 32*b*. It is noted that the outer upwardly extending base walls 37 curve inwardly to frictionally engage the downward portion 27 of the intermediate member 13.

While FIG. 3 is another version of FIG. 1 and the same numbers are used on the drawing. Since there are no ribs to hold a brush/applicator, the open space can be used for a full sized foam pad.

Figure 4:
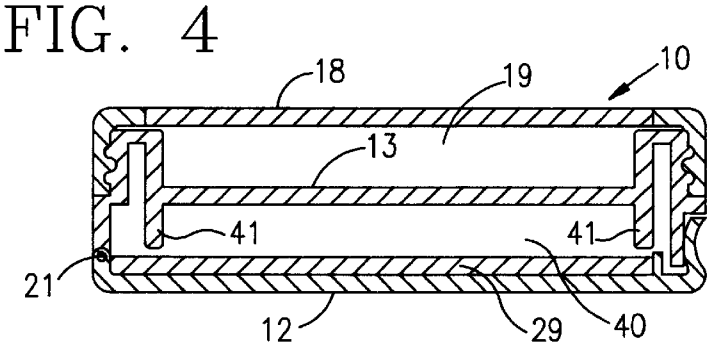
FIG. 4 is an alternate embodiment of the invention with another cavity on the underside of the top cavity; and, FIG. 5 is an alternate embodiment of the invention with a pin hinged cover.

FIG. 4 is another version of FIG. 1 with another cavity 40 on the underside of the top cavity 19. This additional cavity 40 is formed by walls 41 and can be used to hold another product.

Figure 5:
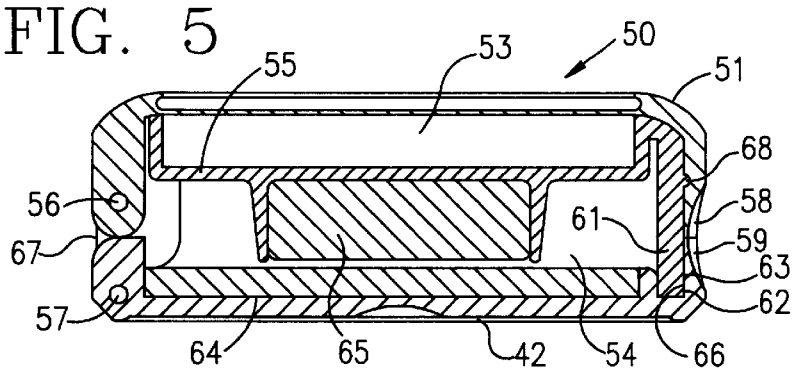

FIG. 5 is an alternate embodiment of FIG. 1 with a pin hinged top cover 51 and a pin hinged base cover 42. The jar or compact 50 is divided internally into two compartments 53 and 54 by a transverse member 55. The upper compartment 53 is used for the product while the lower compartment 54 contains an applicator 65. The covers 51 and 42 are hinged by pins 56 and 57 to the wall portion 67. The covers include indented portions 58 and 59 for ease of opening. Detent 68 holds the cover 51 in place while projecting portion 61 engages recess 62 and the outer portion 63 presses against a portion 66 of the base 42 to hold the pot closed. The base 42 may be swung completely open to permit viewing of the mirror 64.

While the invention has been explained by a detailed description of certain specific embodiments, it is understood that various modifications and substitutions can be made in any of them within the scope of the appended claims which are intended also to include equivalents of such embodiments.

What is claimed is:

1. A cosmetic pot and storage device comprising:

a hollow main body portion having an upper compartment for product storage, a large lower compartment and a solid transverse member separating said compartments and having an upwardly extending threaded outer peripheral wall and an end portion on said wall including a recessed aperture;

a cover having a top surface and downwardly extending threaded outer walls to engage the threads on the transverse member forming the upper compartment and a clear window mounted in the center of said cover to permit viewing of product;

a hinge comprising a pin; and, a base having a bottom portion having an inner surface with a mirror mounted thereon and a holder extending downwardly from the transverse member within the lower compartment to hold accessories and upwardly extending outer walls forming the lower compartment and having a recessed aperture wherein said walls are hinged at one end to the transverse member with the pin extending through the apertures in the transverse member and the upwardly extending walls of the bottom portion in a flush alignment to permit complete uninhibited opening and access to the lower compartment.

2. A cosmetic pot having and a storage device in accordance with claim 1 further including:

a snap in hinge to secure the hinged base portion to the transverse member.

3. A cosmetic pot and storage device in accordance with claim 1 wherein:

the lower compartment comprises an open space for storage purposes.

4. A cosmetic pot and storage device in accordance with claim 1 wherein:

the main body portion is round and the cover, base, and transverse member are similarly round.

5. A cosmetic pot and storage device in accordance with claim 1 wherein:

the main body portion, the cover base and transverse member each comprise a predetermined compatible geometrical configuration.

6. A cosmetic pot and storage device in accordance with claim 1 wherein:

the cover comprises a one piece construction.

7. A cosmetic pot and storage device comprising:

a hollow main body portion having an upper compartment, a larger lower compartment and a solid transverse member separating said compartments;

a cover having a top surface and downwardly extending outer walls wherein said walls are flush hinged at one end to the transverse member forming the upper compartment and having a clear window mounted in the center of said cover, a base having a bottom portion and upwardly extending outer walls at the lower compartment wherein said walls are flush hinged at one end of the walls to the transverse member to permit uninhibited opening and access to the lower compartment; and wherein the base further includes an inner surface having a mirror mounted.

8. A cosmetic pot and storage device in accordance with claim 7 wherein:

the transverse member includes a holder extending downwardly from the transverse member to hold accessories.

9. A cosmetic pot having an upper compartment or product storage and a lower hollow compartment in accordance with claim 8 further including:

a pin hinge mounted to the transverse member at one end and to the cover at the other end and a pin hinge mounted to the transverse member at one end and the base cover at the other end to pivotably secure the cover and base respectively to the transverse member.

10. A cosmetic pot and storage device in accordance with claim 8 further including:

a snap-in hinge to secure the base and a snap-in hinge to secure the cover to the transverse member.

11. A cosmetic pot and storage device in accordance with claim 8 wherein:

the lower compartment comprises an open space for storage purposes.

12. A cosmetic pot and storage device in accordance with claim 8 wherein:

the main body portion is round and the cover, base and transverse member are similarly round.

13. A cosmetic pot and storage device in accordance with claim 8 wherein:

the main body portion, the cover base and transverse member are a predetermined compatible geometrical configuration.

14. A cosmetic pot and storage device in accordance with claim 8 wherein:

the cover comprises a one piece construction.

15. A cosmetic pot and storage device comprising:

a hollow main body portion having an upper compartment for product storage, a large lower compartment and a solid transverse member separating said compartments and having an upwardly extending threaded outer peripheral wall and an end portion on said wall including a recessed aperture;

a cover having a top surface and downwardly extending threaded outer walls to engage the threads on the transverse member forming the upper compartment and a clear window mounted in the center of said cover to permit viewing of product a hinge comprising a pin; and, a base having a bottom portion and upwardly extending outer walls forming the lower compartment and having a recessed aperture wherein said walls are hinged at one end to the transverse member with the pin extending through the apertures in the transverse member and the upwardly extending walls of the bottom portion in a flush alignment to permit complete uninhibited opening and access to the lower compartment, said transverse member comprising a central base portion, an upwardly extending portion at the periphery of the base portion, a transverse portion parallel to the base portion, and a downwardly extending wall having an outward protrusion to engage the cover.

* * * * *